US005763995A

United States Patent [19]

Sano et al.

[11] Patent Number: 5,763,995

[45] Date of Patent: Jun. 9, 1998

[54] CATHODE RAY TUBE

[75] Inventors: Yuuichi Sano, Fukaya; Masahiro Yokota, Kumagaya; Tadahiro Kojima, Fukaya, all of Japan; Eiji Kamohara, Horseheads, N.Y.

[73] Assignee: Kabushiki Kaisha Toshiba, Kawasaki, Japan

[21] Appl. No.: 855,644

[22] Filed: May 13, 1997

[30] Foreign Application Priority Data

May 14, 1996 [JP] Japan ..... 8-118890

[51] Int. Cl.[6] ..... H01J 29/86

[52] U.S. Cl. ..... 313/477 R

[58] Field of Search ..... 313/477 R, 440; 220/2.1 A

[56] References Cited

U.S. PATENT DOCUMENTS 3,731,129 5/1973 Tsuneta et al. .

5,258,688 11/1993 Fondrk ..... 313/477 R

FOREIGN PATENT DOCUMENTS 48-34349 10/1973 Japan .

8-7792 1/1996 Japan .

*Primary Examiner*—Nimeshkumar Patel

*Attorney, Agent, or Firm*—Cushman Darby Cushman IP Group of Pillsbury Madison & Sutro, LLP

[57] ABSTRACT

This cathode ray tube includes a vacuum envelope having a substantially rectangular panel, a funnel formed contiguous to the panel, and a cylindrical neck formed contiguous to the small-diameter end portion of the funnel, an electron gun assembly disposed in the neck to generate electron beams, and a deflection yoke mounted on the outer side of the funnel near the neck side over a predetermined range to form a magnetic field in the funnel, thereby deflecting the electron beams along the major and minor axes of the panel. Of the predetermined range of the funnel, at the neck side, the funnel is formed to have an outer shape with a section which is gradually deformed, from the neck side to the panel side, from a circular shape to a non-circular shape having a maximum diameter along a direction other than the major and minor axes. The funnel of the predetermined range is formed to have an outer shape with a section that satisfies a relation:

$$0.3 \leqq \Delta HV/L \leqq 0.6$$

where L is the radius of the maximum diameter, ΔH is the difference between the radius L and a radius H along the major axis, ΔV is the difference between the radius L and a radius V along the minor axis, and ΔHV is the sum of ΔH and ΔV.

5 Claims, 7 Drawing Sheets

| | HORIZONTAL DEFLECTION SENSITIVITY [mH・A2] | VACUUM STRESS Max. [psi] | SHAPE OF FUNNEL INTERMEDIATE REGION | |
|---|---|---|---|---|
| CURVE 30 | 24 | 1150～1200 | APPROPRIATE SHAPE | SENSITIVITY IS OK, STRENGTH IS OK |
| CURVE 31 | 28 | 1200～1350 | ΔHv NEAR CENTER IS SMALL | DECREASE OF SENSITIVITY IS INSUFFICIENT |
| CURVE 32 | 23 | 1690～ | ΔHv NEAR CENTER IS LARGE | STRENGTH IS SMALL |

FIG. 15

CATHODE RAY TUBE

BACKGROUND OF THE INVENTION

The present invention relates to a cathode ray tube, e.g., a color picture tube, and more particularly, to a cathode ray tube capable of effectively decreasing the consumption power of the deflection yoke and the leakage magnetic field generated by the deflection yoke.

FIG. 1A shows a color picture tube as an example of a conventional cathode ray tube. This color picture tube has a vacuum envelope. The vacuum envelope is formed with a substantially rectangular glass panel 1, a glass funnel 2 formed contiguous to the panel 1, and a cylindrical glass neck 3 formed contiguous to the small-diameter end portion of the funnel 2. As shown in FIG. 1B, a substantially rectangular phosphor screen 4 including three dot-like or stripe-like color phosphor layers respectively emitting blue, green, and red light is formed on the inner surface of the panel 1.

An electron gun assembly 7 for emitting three electron beams 6 is arranged in the neck 3. This electron gun assembly 7 is an in-line electron gun assembly that emits the three electron beams 6 arranged in a line on the same horizontal plane.

A deflection yoke 8 is mounted on the outer side of the funnel 2 near the neck 3 side. The deflection yoke 8 generates a pincushion type horizontal deflection field and a barrel type vertical deflection field.

The three electron beams 6 arranged in a line and emitted from the electron gun assembly 7 are deflected by the horizontal and vertical deflection fields generated by the deflection yoke 8 in a horizontal direction H and a vertical direction V. Hence, when they reach the phosphor screen 4 through a shadow mask, the three electron beams 6 arranged in a line converge on the entire portion of the phosphor screen 4, i.e., on the entire screen surface without requiring an extra correction unit, and horizontally and vertically scan the phosphor screen 4, thereby displaying a color image.

The color picture tube having this structure is called a self convergence in-line color picture tube and is widely in use.

In such a cathode ray tube, e.g., a color picture tube, it is important to decrease the consumption power of the deflection yoke 8 which is the maximum power consumption source. More specifically, in order to improve the screen luminance, the anode voltage for finally accelerating the electron beams must be increased. In order to cope with OA equipments, e.g., a HDTV or a High Definition TV and a PC or a Personal Computer, the deflection frequency must be increased. An increase in anode voltage and an increase in deflection frequency cause an increase in deflection power, i.e., an increase in consumption power of the deflection yoke. In particular, when the electron beams are deflected with a high frequency, the deflection field tends to leak to the outside of the cathode ray tube. For this reason, for a PC in which the operator sits close to the cathode ray tube, regulations against the leakage magnetic field are strict.

In order to decrease the leakage magnetic field, conventionally, a method of adding a compensation coil is generally employed. When, however, a compensation coil is added, the consumption power of the PC increases accordingly.

Therefore, in order to decrease the deflection power and the leakage magnetic field, it is preferable to decrease the neck diameter of the cathode ray tube and the outer diameter of the funnel near the neck side on which the deflection yoke is mounted, so that the deflection field efficiently acts on the electron beams.

In the cathode ray tube, when an electron beam is deflected in a direction along the maximum dimension of the screen, i.e., along the diagonal direction, the deflection angle of the electron beam, i.e., the angle the trace of the deflected electron beam makes with the Z axis becomes large. When the deflection angle of the electron beam increases, the electron beam passes closely to the inner surface of the funnel near the neck side on which the deflection yoke is mounted. Thus, if the neck diameter and the outer diameter of the funnel near the neck side are simply decreased, the outer electron beam 6 bombards the inner wall of the funnel 2 near the neck 3 side, as shown in FIG. 1A. When electron beam 6 bombards the inner wall of the funnel 2, a portion 10 where the electron beam 6 does not reach is formed on the phosphor screen 4, as shown in FIG. 1B.

Therefore, in the conventional cathode ray tube, the neck diameter and the outer diameter of the funnel near the neck side cannot be simply decreased. Accordingly, it is difficult to decrease the deflection power and the leakage magnetic field. If the electron beams 6 continue to bombard the inner wall of the funnel 2 near the neck 3 side, the temperature of this portion rises to melt the glass. Then, a portion of the inner wall of the funnel becomes thin, and the funnel may break from this portion.

In order to solve these problems, Jpn. Pat. Appln. KOKOKU Publication No. 48-34349 discloses a cathode ray tube 12 as shown in FIG. 2A. This tube is developed based on the fact that when drawing a rectangular raster on a phosphor screen, a passing region which is defined by the trace of an electron beam passing inside the funnel near the neck side on which the deflection yoke is mounted also becomes substantially rectangular. More specifically, in this cathode ray tube 12, as shown in FIGS. 2B to 2F showing the sections of the cathode ray tube 12 taken along the lines IIB—IIB to IIF—IIF, respectively, the section of a funnel 2 near the neck 3 side, on which the deflection yoke is mounted, gradually changes, from the neck 3 side to the panel 1 side, from a circular shape to a substantially rectangular shape through an elliptic shape.

In a cathode ray tube a funnel of which near the neck side on which a deflection yoke is mounted is formed with sections as shown in FIGS. 2B to 2F, the inner diameter of the diagonal portion, i.e., a portion near the diagonal axis (D axis), where the electron beams tend to land, becomes large, as shown in FIG. 3, as compared to that in a cathode ray tube a funnel 2 of which near the neck side remains circular. This prevents the electron beams from impinging upon the inner wall of the funnel.

In the cathode ray tube having a structure as shown in FIGS. 2B to 2F, its inner diameter near the major axis, i.e., the horizontal axis (H axis), and its inner diameter near the minor axis, i.e., the vertical axis (V axis), become shorter than in the cathode ray tube the funnel 2 of which near the neck side remains circular. This aims at setting the horizontal deflection coil and the vertical deflection coil of the deflection yoke to be closer to the passing region of the electron beams in order to efficiently deflect the electron beams, thereby decreasing the deflection power.

In this cathode ray tube, however, the closer to a rectangle the section of the funnel near the neck side on which the deflection yoke is mounted is, the smaller the atmospheric pressure resistance is, and a safety concern is lowered. Therefore, in practice, the shape of the funnel near the neck side must be appropriately rounded, and the deflection power and the leakage magnetic field cannot thus be decreased sufficiently.

As described above, it is very difficult to realize a decrease in deflection power and leakage magnetic field of a cathode ray tube while satisfying demands for a higher luminance and a higher frequency required by a display equipment, e.g., a HDTV and a PC. Conventionally, in a structure proposed to reduce the deflection power of a cathode ray tube, the shape of a funnel near the neck side on which a deflection yoke is mounted gradually changes, from the neck side to the panel side, from a circular shape to a substantially rectangular shape through an elliptic shape.

If, however, the section of the funnel near the neck side draws nearer a rectangle in this manner, the atmospheric pressure resistance suffers, presenting the problem of safety. Therefore, in practice, the shape of the funnel near the neck side must be appropriately rounded, and the deflection power cannot thus be decreased sufficiently. Also, at the time the above-mentioned official gazette was published, the simulation techniques for designing the shape of the envelope of the cathode ray tube were not mature yet, and electron beam trace analysis and deflection field analysis as accurate as those nowadays done could not be performed. Therefore, a funnel that could decrease the deflection power and the leakage magnetic field while maintaining the atmospheric pressure resistance could not be designed.

BRIEF SUMMARY OF THE INVENTION

The present invention has been made in order to solve the above problems, and has as its object to provide a cathode ray tube capable of reducing the deflection power and leakage magnetic field and preventing a decrease in atmospheric pressure resistance while satisfying demands for a higher luminance and a higher frequency.

According to the present invention, there is provided a cathode ray tube comprising:

a vacuum envelope having a substantially rectangular panel, a funnel formed contiguous to the panel, and a cylindrical neck formed contiguous to a small-diameter end portion of the funnel;

an electron gun assembly disposed in the neck to generate electron beams; and a deflection yoke mounted on an outer side of the funnel near a neck side over a predetermined range to generate a magnetic field in the funnel, thereby deflecting the electron beams along a major axis and a minor axis of the panel, wherein the funnel of the predetermined range is formed to have an outer shape with a section which is gradually deformed, from the neck side to the panel side, from a circular shape to a non-circular shape having a maximum diameter along a direction other than the major axis and the minor axis, and of the predetermined range of the funnel, near the panel, the funnel is formed to have an outer shape with a section that satisfies a relation:

$$0.3 \leqq \Delta HV/L \leqq 0.6$$

where L is a radius of the maximum diameter, ΔH is a difference between the radius L and a radius H along the major axis, ΔV is a difference between the radius L and a radius V along the minor axis, and ΔHV is a sum of ΔH and ΔV.

According to the cathode ray tube of the present invention, of the predetermined range of the funnel on which the deflection yoke is mounted, a portion near the panel is formed such that an outer shape of the funnel satisfies a relation:

$$0.3 \leqq \Delta HV/L \leqq 0.6$$

Therefore, the non-circularity ratio becomes large in the funnel within the predetermined range on the panel side. Accordingly, the sensitivity of the magnetic field formed in the funnel is increased, and the electron beams can be deflected efficiently. Hence, the deflection power can be decreased.

Since the non-circularity ratio becomes large in the funnel within the predetermined range on the panel side, among the components of the magnetic field generated by the deflection yoke, a component pointing in the direction of the panel is decreased. As a result, the leakage magnetic field from the panel can be decreased.

Furthermore, since the deflection yoke is mounted over the predetermined range of the funnel having the shape described above, the deflection yoke can be made compact, so that the deflection power and the leakage magnetic field from the deflection yoke can be largely decreased.

A wide angle deflection cathode ray tube that can deflect an electron beam with a deflection angle of 110° or more can perform deflection with a practical deflection frequency. The tube can also clear the standard value for the leakage magnetic field.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 15 is a table showing the maximum values of the horizontal deflection sensitivity and vacuum stress of the funnel having the shape shown in FIG. 10.

DETAILED DESCRIPTION OF THE INVENTION

A color picture tube according to an embodiment of the present invention as an example of a cathode ray tube will be described with reference to the accompanying drawings.

Figure 1A:
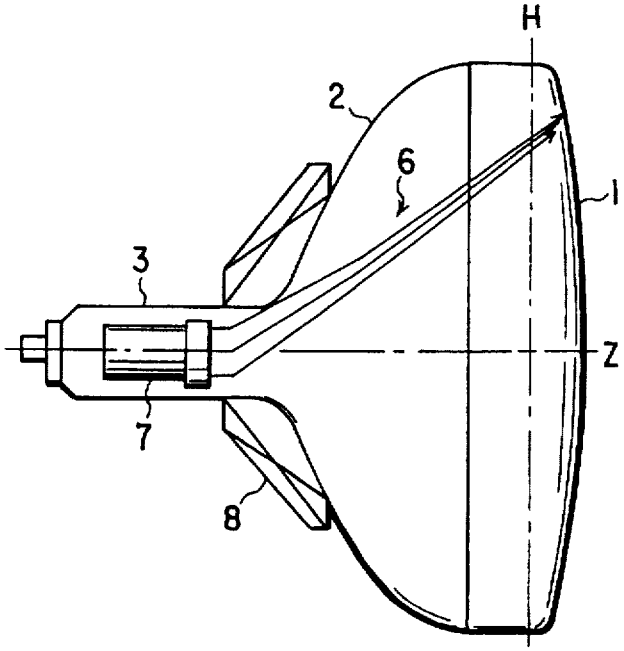
FIG. 1A (PRIOR ART)
FIG. 1A is a sectional view showing a conventional cathode ray tube.
Figure 1B:
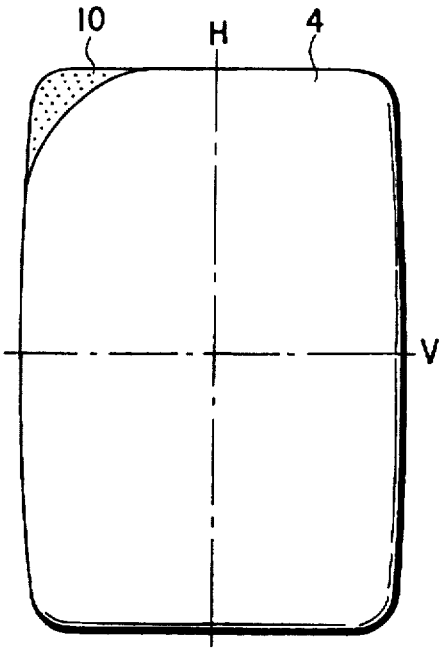
FIG. 1B (PRIOR ART)
FIG. 1B is a front view of the cathode ray tube shown in FIG. 1A.
Figure 3:
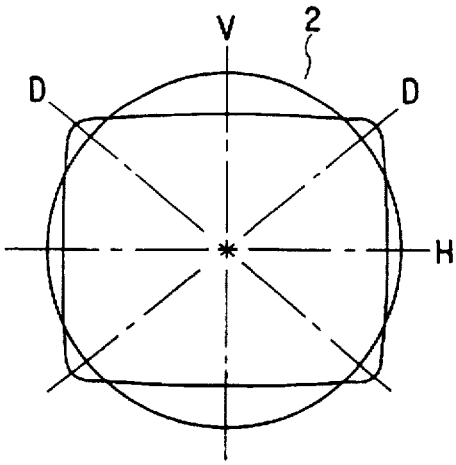
FIG. 3 (PRIOR ART)
FIG. 3 is a view for explaining an electron beam passing region obtained when a funnel near the neck side on which a deflection yoke is mounted is substantially rectangular.
Figure 2A:
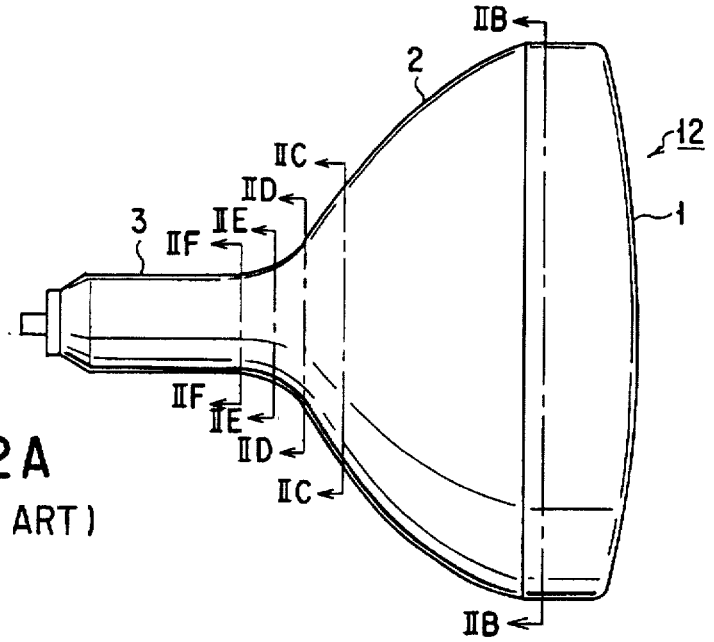
FIG. 2A (PRIOR ART)
FIG. 2A is a side view of the conventional cathode ray tube.
Figure 2B:
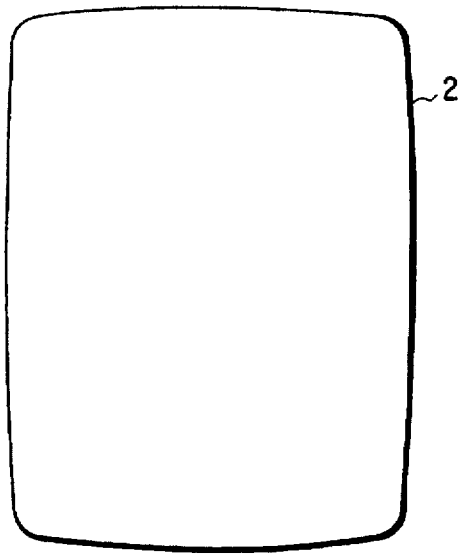
FIG. 2B (PRIOR ART)
FIGS. 2B to 2F are sectional views taken along the lines IIB—IIB to IIF—IIF, respectively, of FIG. 2A.
Figure 2C:
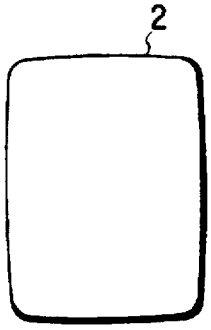
FIG. 2C (PRIOR ART)
Figure 2D:
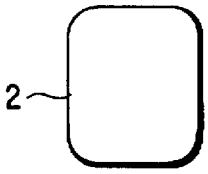
FIG. 2D (PRIOR ART)
Figure 2E:
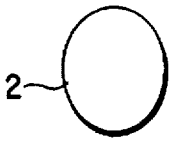
FIG. 2E (PRIOR ART)
Figure 2F:
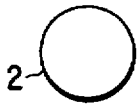
FIG. 2F (PRIOR ART)
Figure 4:
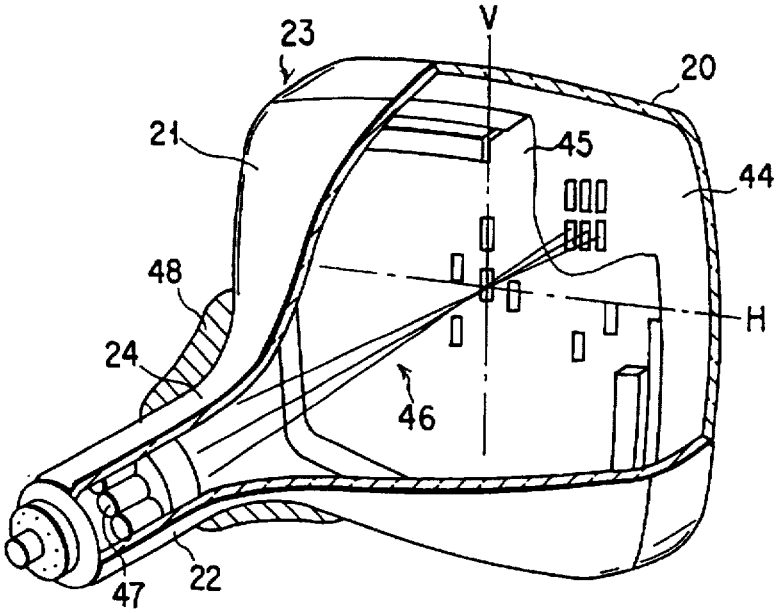
FIG. 4 is a view schematically showing the structure of a cathode ray tube, i.e., a color picture tube, according to an embodiment of the present invention.

As shown in FIG. 4, this color picture tube has a vacuum envelope 23. The vacuum envelope 23 is formed with a substantially rectangular glass panel 20, a glass funnel 21 formed contiguous to the panel 20, and a cylindrical glass neck 22 formed contiguous to the small-diameter end portion of the funnel 21. A substantially rectangular phosphor screen 44 including three dot-like or stripe-like color phosphor layers respectively emitting blue, green, and red light is formed on the inner surface of the panel 20. A shadow mask 45 having a large number of electron beam apertures is arranged inside the phosphor screen 44 to oppose it, i.e., on the neck side of the phosphor screen 44.

An electron gun assembly 47 for emitting three electron beams 46 is disposed in the neck 22. This electron gun assembly 47 is an in-line electron gun assembly that emits the three electron beams 46 arranged in a line on the same horizontal plane.

A deflection yoke 48 is mounted on the funnel 21 near the neck 22 side, i.e., on the outer side of a funnel intermediate region 24 of the funnel 21. The deflection yoke 48 generates a pincushion type horizontal deflection field and a barrel type vertical deflection field.

The three electron beams 46 emitted from the electron gun assembly 47 are deflected by the horizontal deflection field generated by the deflection yoke 48 in the major axis direction, i.e., the horizontal axis (H axis) direction. Also, these three electron beams 46 are deflected by the vertical deflection field generated by the deflection yoke 48 in the minor axis direction, i.e., the vertical axis (V axis) direction. Hence, when the three electron beams 46 arranged in a line and emitted from the electron gun assembly 47 reach the phosphor screen 44 through the shadow mask 45, they horizontally and vertically scan the entire portion of the phosphor screen 44, i.e., the entire screen, thereby displaying a color image.

The color picture tube having this structure is called a self convergence in-line color picture tube as the three electron beams 46 arranged in a line converge on the entire surface of the screen without requiring an extra correction unit.

Figure 5:
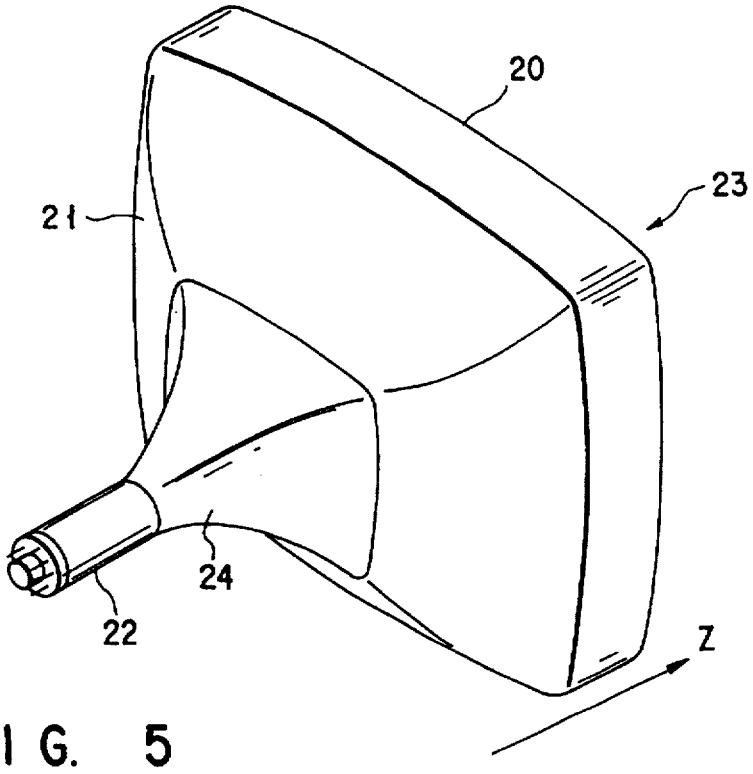
FIG. 5 is a view showing the envelope of the color picture tube shown in FIG. 4.

FIG. 5 shows an example of the structure of the vacuum envelope 23.

Assuming that the tube axis direction of the vacuum envelope 23, i.e., the direction along which the electron beams are emitted without being deflected, is defined as the Z axis, the section of the panel 20 perpendicularly intersecting the Z axis has a substantially rectangle shape defined by the long sides of the panel substantially parallel to the major axis and the short sides of the panel substantially parallel to the minor axis. The section of the neck 22 perpendicularly intersecting the Z axis has a circular shape. Regarding the funnel intermediate region 24 of the funnel 21 near the neck 22 side, its section perpendicularly intersecting the Z axis changes along the Z axis.

More specifically, the section of the funnel intermediate region 24 on which the deflection yoke is mounted gradually changes, from the neck 22 side to the panel 20 side along the Z axis, from a circular shape similar to that of the neck 22 to a non-circular shape having the maximum diameter along a direction other than the major and minor axes of the panel 20. In other words, at the panel 20 side, the section of the funnel intermediate region 24 has a rectangular shape close to a substantially rectangular shape defined by the long sides and short sides of the panel. The direction of the maximum dimension other than the major and minor axes is parallel to the diagonal direction of the panel 20, i.e., the diagonal axis (D axis).

Figure 6:
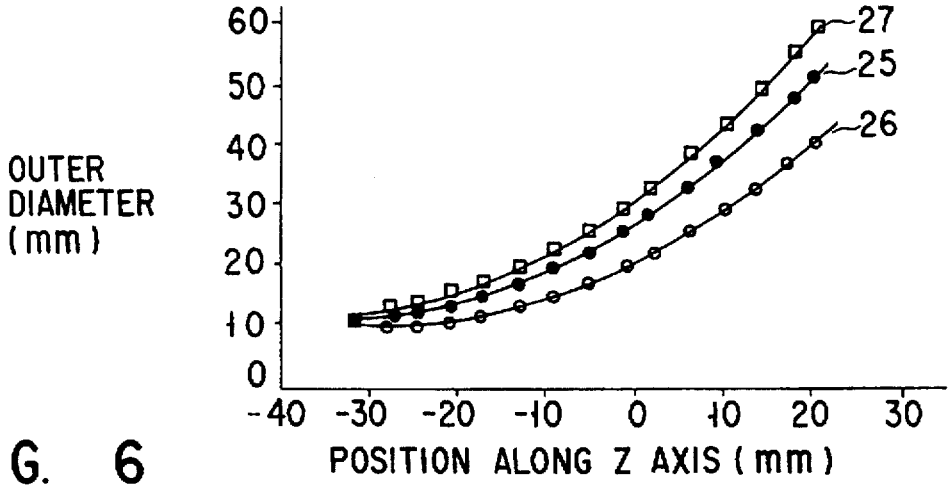
FIG. 6 is a graph showing the relationship between the outer diameter of the funnel of the envelope shown in FIG. 5 near the neck side on which the deflection yoke is mounted and the position along the tube axis, i.e., position along the Z axis.

FIG. 6 shows the relationship between the outer diameter of the funnel intermediate region 24 and the position along the Z axis, i.e., the position along the tube axis. In FIG. 6, a curve 25 indicates a radius of the outer diameter along the major axis with respect to the Z axis, a curve 26 indicates a radius of the outer diameter along the minor axis with respect to the Z axis, and a curve 27 indicates a radius of the outer diameter along the diagonal axis with respect to the Z axis.

The origin along the tube axis, i.e., the 0-mm position, is called the deflection center, which is the nearest tangent point of the Z axis and a tangent line to a trace, among the traces of the electron beams deflected to the corner position where the long and short sides of the panel intersect, which is the closest to the corner position. In FIG. 6, the panel side is positive and the neck side is negative, respectively, with respect to this deflection center.

As shown in FIG. 6, near the portion of the funnel intermediate region 24 contiguous to the neck, i.e., the −32-mm position on the Z axis in this example, the outer diameters along the major axis, the minor axis, and the diagonal axis are identical, and the section of this portion is thus circular. In the funnel intermediate region 24, the closer to the panel side, the smaller the rate of increase of the outer diameter of the section along each of the major and minor axes, and the section of the funnel intermediate region 24 is flattened non-circularly, i.e., rectangularly.

Figure 7:
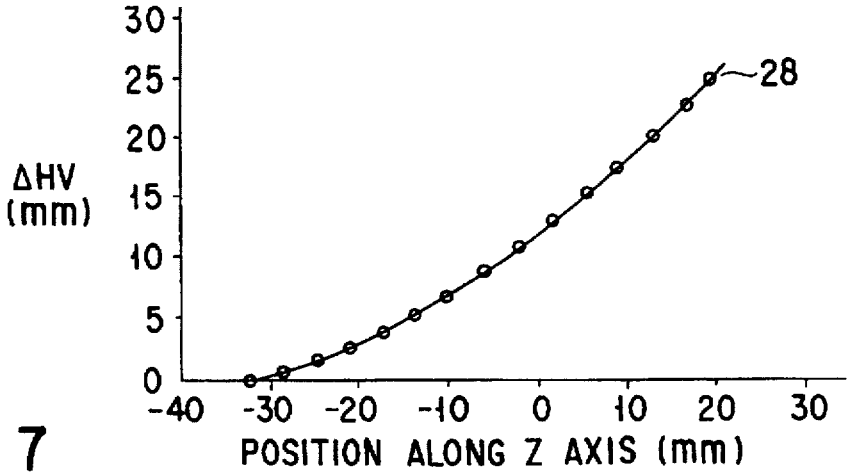
FIG. 7 is a graph showing changes in a sum ΔHV of a difference ΔH between a radius of the maximum outer diameter and a radius of the outer diameter along the major axis and a difference ΔV between a radius of the maximum outer diameter and a radius of the outer diameter along the minor axis with respect to the position along the tube axis.
Figure 8:
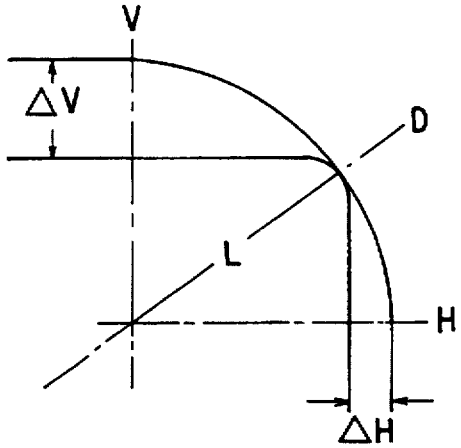
FIG. 8 is a view for explaining the difference ΔH and the difference ΔV of the funnel shown in FIG. 5 near the neck side.

As shown in FIG. 8, assume that the radius of the maximum outer diameter, i.e., the outer diameter along the diagonal axis, among the outer diameters of the funnel intermediate region 24, is defined as L, that the difference between the radius L of this maximum outer diameter and the radius of the outer diameter along the major axis is defined as ΔH, and that the difference between the radius L of the maximum outer diameter and the radius of the outer diameter along the minor axis is defined as ΔV. If the sum of ΔH and ΔV is defined as ΔHV, that is, if $$\Delta HV=\Delta H+\Delta V$$

then this AHV changes as indicated by a curve 28 in FIG. 7.

Figure 9:
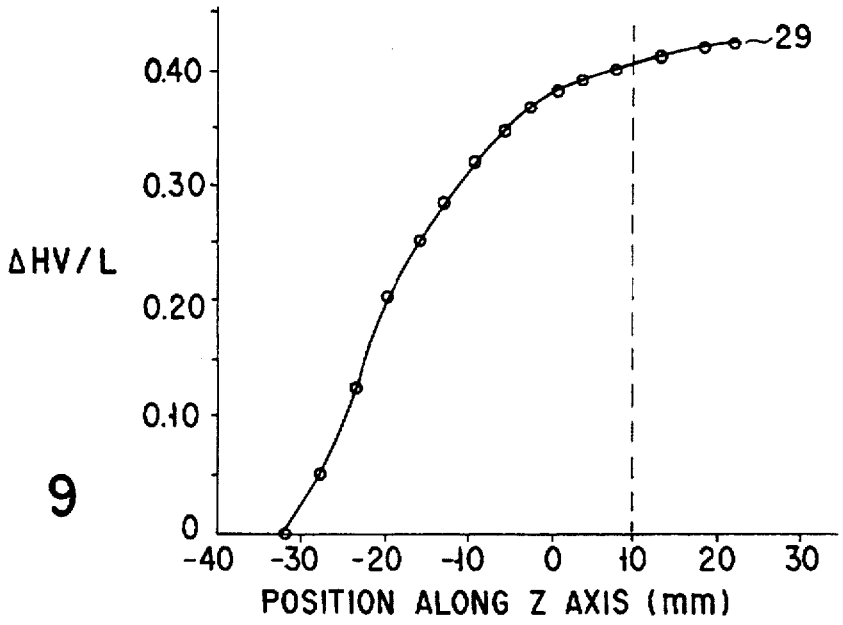
FIG. 9 is a graph showing the non-circularity ratio of the funnel shown in FIG. 5 near the neck side.

ΔHV/L indicating the non-circularity ratio, i.e., flattening ratio, of the funnel intermediate region changes as indicated by a curve 29 in FIG. 9. In the deflection yoke mounted on this funnel intermediate region and having a saddle type horizontal deflection coil on its front end portion, i.e., near the panel side, its non-circularity ratio ΔHV/L preferably falls within the range of 0.3 or more to 0.6 or less near the position indicated by a broken line in FIG. 9 where the flange portion of the deflection yoke near the panel side is located, i.e., at the +10-mm position along the Z axis. In the example shown in FIG. 9, ΔHV/L=0.4.

In the arrangement of the vacuum envelope, the neck is cylindrical, the panel is rectangular, and the funnel tapers wider from the neck side to the panel side. Therefore, the funnel intermediate region on which the deflection yoke is mounted cannot be formed sharply from the neck side to have a rectangular section having a size with a ratio close to, e.g., the aspect ratio of the screen.

Figure 10:
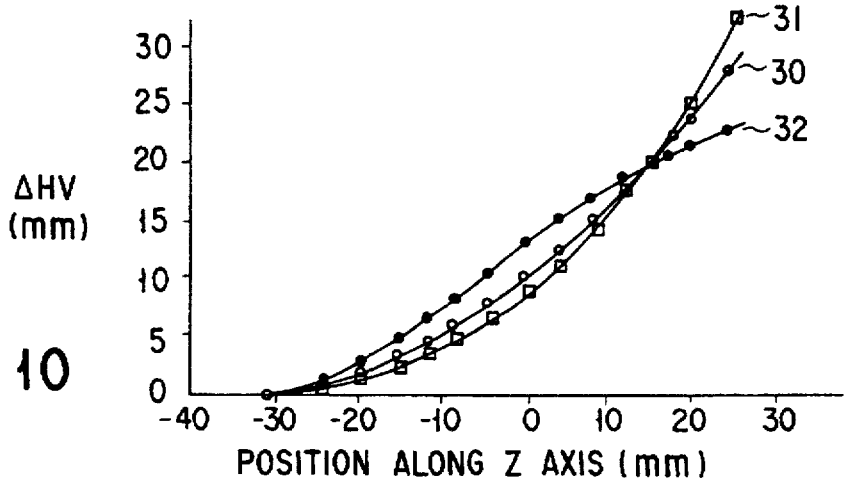
FIG. 10 is a graph for comparing changes in shape of the funnel shown in FIG. 5 near the neck side and changes in shape of other funnels near the neck side.

FIG. 10 shows three typical examples of changes in shape of the funnel intermediate region, on which the deflection yoke is mounted, with respect to the position along the Z axis, i.e., changes in ΔHV.

A curve 30 indicates an example in which ΔHV increases gradually from the neck side to the panel side, i.e., along with an increase in position along the Z axis. The rate of increase of ΔHV, i.e., the slope of the tangent to the curve 30, is about 0.7 at a position of the funnel intermediate region close to the panel.

A curve 31 indicates an example in which the rate of increase of ΔHV is comparatively small at the intermediate portion between the neck side and the panel side, i.e., near the 0-mm position along the Z axis, and increases closer to the panel. In this example, the rate of increase of ΔHV at the position of the funnel intermediate region close to the panel is 1.1 or more.

A curve 32 indicates an example in which the rate of increase of ΔHV is comparatively large at the intermediate portion between the neck side and the panel side and decreases closer to the panel. In this example, the rate of increase of ΔHV at the position of the funnel intermediate region close to the panel is 0.6 or less.

Of these three examples, when the rate of increase of ΔHV is large at the intermediate portion, as in the example indicated by the curve 32, the sectional shape of the funnel intermediate region sharply changes with respect to the position along the Z axis. A funnel having such a shape tends to have poor mechanical strength, e.g., atmospheric pressure resistance.

When the rate of increase of ΔHV at the position of the funnel intermediate region close to the panel is large, as in the example indicated by the curve 31, the sensitivity of the deflection field that acts on the electron beams to deflect them deteriorates.

FIG. 15 shows the comparison of the results of these examples in detail.

The vacuum stresses shown in FIG. 15 are the maximum values. In order to stably ensure the mechanical strength, the vacuum stress is preferably 1,200 psi or less.

More specifically, a funnel having a shape as indicated by the curve 30 is an appropriate one having a funnel intermediate region with ΔHV which gradually increases along the tube axis. The deflection field, e.g., the horizontal deflection field, of this funnel intermediate region has good sensitivity. The maximum value of the vacuum stress of this funnel intermediate region is 1,200 psi or less throughout the entire region along the tube axis, with which a large mechanical strength can be maintained.

In a funnel having a shape as indicated by the curve 31, the rate of increase of ΔHV of its funnel intermediate region is small near substantially the center of the tube axis. ΔHV is small at the portion where the strength of deflection field is highest. Therefore, it is difficult to sufficiently reduce the deflection sensitivity. In this funnel intermediate region, ΔHV increases sharply near the panel side, and the maximum value of the vacuum stress exceeds 1,200 psi at many regions. Therefore, it is difficult to sufficiently maintain a large mechanical strength throughout the entire portion of the funnel intermediate region.

In a funnel having a shape as indicated by the curve 32, the rate of increase of ΔHV of its funnel intermediate region is large near substantially the center of the tube axis. In this funnel intermediate region, the maximum value of the vacuum stress is very high, and a sufficiently high mechanical strength cannot thus be maintained.

Therefore, in practice, it is preferable that ΔHV gradually increase from the neck side to the panel side, as in the example indicated by the curve 30, and that the rate of increase of ΔHV at the position of the funnel intermediate region near the panel side be larger than 0.6 and less than 1.1. If the funnel intermediate region has such a structure, a funnel having a desired shape and capable of sufficiently maintaining a large atmospheric pressure resistance can be formed without decreasing the sensitivity of the deflection field.

In this manner, if the section of the funnel intermediate region on which the deflection yoke is mounted is gradually changed, from the neck side to the panel side, from a circular shape to a rectangular shape having a size with a ratio close to the aspect ratio of the panel, and if the non-circularity ratio ΔHV/L at the position close to the panel where the front end portion of the deflection yoke is located is set to satisfy:

$$0.3 \leqq \Delta HV/L \leqq 0.6$$

then the deflection power can be decreased.

Figure 11:
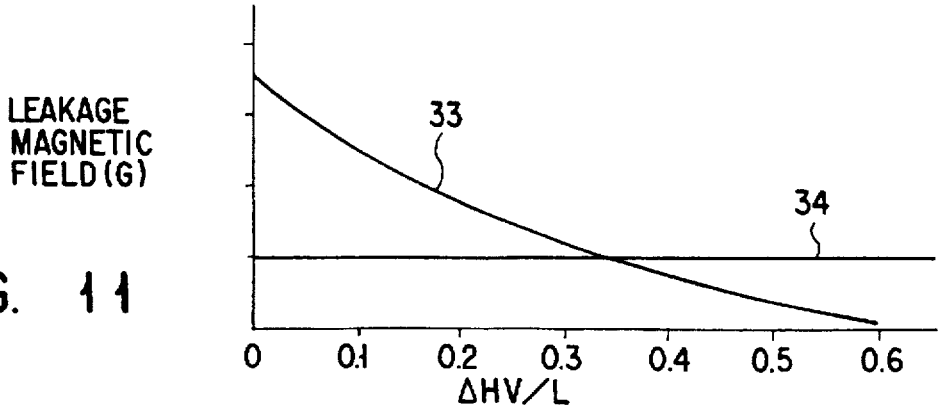
FIG. 11 is a graph showing the relationship between the non-circularity ratio of the funnel shown in FIG. 5 near the neck side and the leakage magnetic field.

FIG. 11 shows the relationship between the strength of leakage magnetic field and the non-circularity ratio ΔHV/L. The standard value of the leakage magnetic field is indicated by a straight line 34 in FIG. 11. If the non-circularity ratio ΔHV/L is set to 0.3 or more, preferably 0.35 or more, as indicated by a curve 33, the leakage magnetic field can be set to be equal to the standard value or less.

If the rate of increase of ΔHV at a position of the funnel intermediate region close to the panel is set to be larger than 0.6 and less than 1.1, as indicated by the curve 30 in FIG. 10, a funnel having a sufficiently large atmospheric pressure resistance can be formed.

Therefore, if a funnel is formed based on the design conditions described above, a color picture tube capable of decreasing the deflection power and the leakage magnetic field and having a sufficiently large atmospheric pressure resistance can be obtained while satisfying demands for a higher luminance and a higher frequency.

The design conditions described above are obtained as a result of elaborate analysis on the magnetic field of the deflection yoke which is mounted on the cathode ray tube.

More specifically, in order to decrease the deflection power of the cathode ray tube, the funnel near the neck side on which the deflection yoke is mounted, i.e., the funnel intermediate region, must be formed to have a small diameter as much as possible, and the deflection coil must be small. In this case, the deflected electron beams should not bombard the inner wall of the neck of the funnel. For this purpose, the inner wall of the funnel susceptible to impingement of the electron beams is preferably formed into a shape having a size with a ratio close to the aspect ratio of the screen. Such a funnel preferably has an outer diameter that increases from the neck side to the panel side, and a section near the panel side and perpendicularly intersecting the tube axis, which has a non-circular shape, e.g., a substantially a rectangular shape, having its maximum diameter along a direction other than the major or minor axis of the panel. A deflection coil to be mounted on this funnel intermediate region preferably has a shape matching the outer size of the funnel intermediate region.

Figure 12:
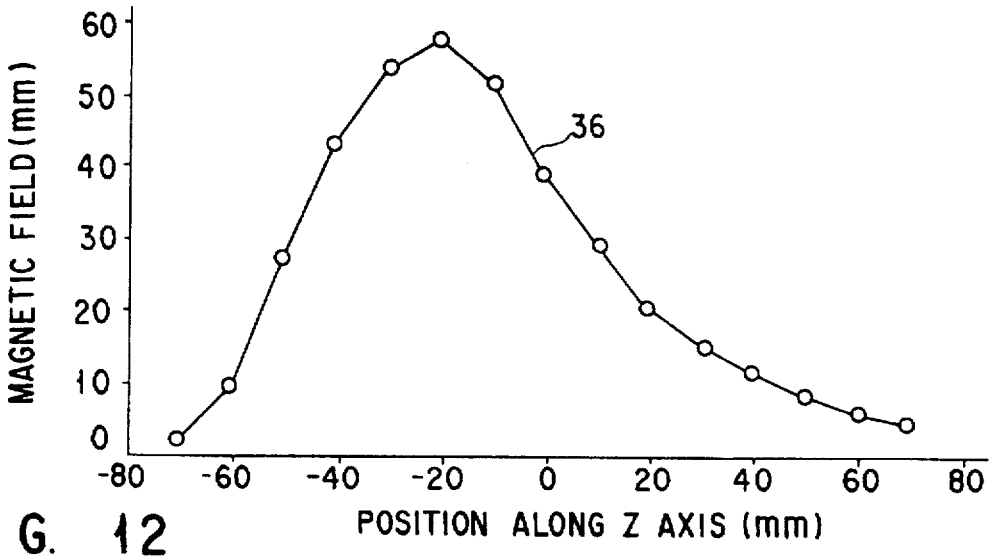
FIG. 12 is a graph showing the strength distribution, along the tube axis, of a deflection field generated by the horizontal deflection coils of the deflection yoke mounted on the funnel shown in FIG. 5.

In general, the strength distribution of a deflection field generated by a deflection coil has its peak value near the center of the deflection coil, as indicated by a curve 36 in FIG. 12. Meanwhile, the outer diameter of the funnel intermediate region on which the deflection yoke is mounted decreases gradually to the neck. Therefore, in order to decrease the deflection power, it is effective to gradually decrease the outer diameter of the funnel to the neck side as much as possible from the peak value of the deflection field strength shown in FIG. 12. Since the deflection power corresponds to the integral of the entire deflection fields that act on the electron beams, it is also important to decrease the outer diameter of the funnel to the panel side from the peak value.

A leakage magnetic field generated by the deflection yoke is mainly generated by a horizontal deflection coil formed at the front end portion of the deflection yoke. This is because the front end portion of the deflection yoke largely opens toward the panel; a strong magnetic field leaks toward the panel, and this leakage magnetic field has an influence to a distant location. Therefore, in order to decrease the leakage magnetic field from the deflection yoke, it is desirable that the outer diameter of the funnel intermediate region where the front end portion of the deflection yoke is located be decreased as much as possible and that the horizontal deflection coil be arranged not to point in the direction of the panel as much as possible.

Figure 13:
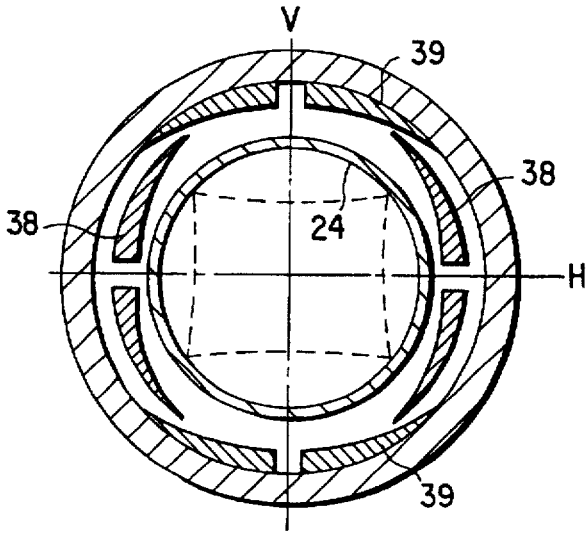
FIG. 13 is a sectional view showing the arrangement of the deflection coils of the deflection yoke mounted on the funnel shown in FIG. 5.

More specifically, in a deflection yoke having, e.g., a saddle type horizontal deflection coil 38 and a saddle type vertical deflection coil 39, as shown in FIG. 13, in order to decrease the diameter of the flange portion of the front end portion of the horizontal deflection coil 38, the outer diameter of the funnel intermediate region 24 along the minor axis, i.e., along the V axis, where this flange portion is located must be decreased. In order to decrease the diameter of the flange portion of the front end portion of the vertical deflection coil 39, the outer diameter of the funnel intermediate region 24 along the major axis, i.e., along the H axis, where this flange portion is located must be decreased.

In order to reduce the deflection power and the leakage magnetic field simultaneously, the funnel intermediate region on which the deflection yoke is mounted must be formed as small as possible. However, according to the magnetic field analysis and experiments on the test samples of the present inventors, in a display tube used in the terminal of a computer or the personal computer, even if a 110° deflection tube was designed by using a conventional funnel, the deflection power could not be sufficiently decreased. Also, the leakage magnetic field was large, and the Sweden standard of the leakage magnetic field could not be cleared.

In contrast to this, as described above, when the funnel intermediate region on which the deflection yoke was mounted was formed to have a section that gradually changes, from the neck side to the panel side, from a circular shape to a non-circular shape having the maximum dimension along a direction other than the major and minor axes of the panel, and when the radius H along the major axis and the radius V along the minor axis were decreased with respect to the radius L of this maximum diameter, both the difference ΔH between the radii L and H and the difference ΔV between the radii L and V are equally contributed to a decrease in deflection power, which is an interesting result. When the ratio ΔHV/L indicating the non-linearity ratio of the funnel intermediate region was set to 0.3 or more, preferably 0.35 or more, the leakage magnetic field could be decreased to have a practical level and the deflection power could be decreased.

Figure 14:
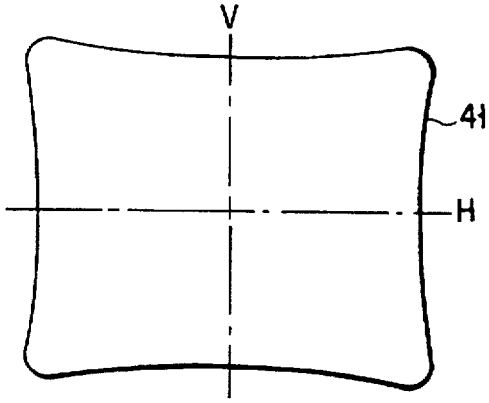
FIG. 14 is a view for explaining the limit of non-circularization of the funnel near the neck side.

In this case, the vacuum envelope must be formed into a shape that can maintain a sufficiently large atmospheric pressure resistance while avoiding a decrease in its mechanical strength. More specifically, even when the funnel intermediate region is designed to have a substantially rectangular section in which ΔHV/L simply becomes 0.3 or more, if the central portions of sides 41 of this section are inwardly arcuated, as shown in FIG. 14, then a very large tension exceeding 1,200 psi acts on the respective corner portions due to the atmospheric pressure load applied to the central portions of the respective sides 41. As a result, the funnel may break, and such an envelope is difficult to be put into practice. As a result, non-circularization of the funnel intermediate region on which the deflection yoke was mounted was limited, and the limit of ΔHV/L was 0.6 or less. This value corresponds to that of a case in which the ratio of the lengths of the section of the funnel intermediate region 24 along the H and V axes is substantially the same as the aspect ratio of the screen.

If the structure of the funnel intermediate region is set such that ΔHV gradually increases from the neck side to the panel side and that the rate of increase of ΔHV at a position of the funnel intermediate region near the panel side is set within the range of more than 0.6 to less than 1.1, a funnel with a desired shape that can sufficiently maintain a large atmospheric pressure resistance can be formed without decreasing the sensitivity of the deflection field.

In the above embodiment, a color picture tube has been described. However, the present invention can similarly be applied to a cathode ray tube other than a color picture tube.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A cathode ray tube comprising:

a vacuum envelope having a substantially rectangular panel, a funnel formed contiguous to said panel, and a cylindrical neck formed contiguous to a small-diameter end portion of said funnel;

an electron gun assembly disposed in said neck to generate electron beams; and a deflection yoke mounted on an outer side of said funnel near a neck side over a predetermined range to generate a magnetic field in said funnel, thereby deflecting the electron beams along a major axis and a minor axis of said panel, wherein said funnel of said predetermined range is formed to have an outer shape with a section which is gradually deformed, from said neck side to said panel side, from a circular shape to a non-circular shape having a maximum diameter along a direction other than the major axis and the minor axis, and of said predetermined range of said funnel, near said panel, said funnel is formed to have an outer shape with a section that satisfies a relation:

$$0.3 \leqq \Delta HV/L \leqq 0.6$$

where L is a radius of the maximum diameter, ΔH is a difference between the radius L and a radius H along the major axis, ΔV is a difference between the radius L and a radius V along the minor axis, and ΔHV is a sum of ΔH and ΔV.

2. A cathode ray tube according to claim 1, wherein, said funnel of said predetermined range is formed to have an outer shape with a section which is gradually deformed, from said neck side to said panel side, from a circular shape to a substantially rectangular shape having a diagonal axis along a direction other than the major axis and the minor axis.

3. A cathode ray tube according to claim 1, wherein, of said predetermined range of said funnel, near said panel, said funnel is formed to have an outer shape with a section of a substantially rectangular shape having a size with a ratio substantially close to a ratio of a length along the major axis to a length along the minor axis of said panel.

4. A cathode ray tube according to claim 1, wherein ΔHV gradually increases from said neck side to said panel side, and a rate of increase of ΔHV near said panel of said predetermined range of said funnel falls within a range of not less than 0.6 to not more than 1.1.

5. A cathode ray tube according to claim 1, wherein, of said predetermined range of said funnel, near said panel, said funnel is formed to have an outer shape with a section that satisfies a relation:

$$0.35 \leqq \Delta HV/L \leqq 0.6.$$

* * * * *